US005303905A

United States Patent [19]

Pohl et al.

[11] Patent Number: 5,303,905

[45] Date of Patent: Apr. 19, 1994

[54] REFRACTORY CERAMIC STOPPER, APPARATUS FOR SUPPORT THEREOF, AND ASSEMBLY THEREOF

[75] Inventors: Siegfried Pohl, Heidenrod-Springen; Dirk Masurat, Wl.-Biebrich; Ernst Lührsen, Bad Schwalbach; Gerd Bohndorf, Oberhausen, all of Fed. Rep. of Germany

[73] Assignee: Didier-Werke AG, Wiesbaden, Fed. Rep. of Germany

[21] Appl. No.: 948,589

[22] Filed: Sep. 23, 1992

[30] Foreign Application Priority Data

Nov. 26, 1991 [DE] Fed. Rep. of Germany ..... 4138812
Apr. 14, 1992 [DE] Fed. Rep. of Germany ..... 4212450

[51] Int. Cl.[5] ..... B22D 41/18
[52] U.S. Cl. ..... 266/271; 222/597; 222/602
[58] Field of Search ..... 222/597, 602; 266/236, 266/271

[56] References Cited

U.S. PATENT DOCUMENTS 1,843,175 2/1932 Sears ..... 222/602
2,005,311 6/1935 Belding ..... 222/602
2,587,110 2/1952 Carter ..... 222/602

FOREIGN PATENT DOCUMENTS 0358535 3/1990 European Pat. Off. .
0003656 1/1986 Japan ..... 222/602

*Primary Examiner*—Scott Kastler
*Attorney, Agent, or Firm*—Wenderoth, Lind & Ponack

[57] ABSTRACT

A refractory ceramic stopper has therein a recess including an annular outwardly enlarged portion defining a stop surface. A stopper rod inserted into the recess in the stopper has a support surface. A plurality of spreadable members having opposite ends are positioned about the stopper rod and are inserted therewith into the recess in the stopper. The spreadable members are spread outwardly such that they enter the enlarged portion of the recess in the stopper with first ends of the spreadable members confronting the stop surface of the stopper and with second ends of the spreadable members confronting the support surface of the stopper rod. Thereby the spreadable members lock the stopper onto the stopper rod.

65 Claims, 4 Drawing Sheets

REFRACTORY CERAMIC STOPPER, APPARATUS FOR SUPPORT THEREOF, AND ASSEMBLY THEREOF

BACKGROUND OF THE INVENTION

The present invention relates to a refractory ceramic stopper of the type employed to close, i.e. stop or plug, a discharge opening in a metallurgical vessel. The present invention also is directed to a stopper rod apparatus to be locked to the stopper with the stopper fitting over a stopper rod, thereby to support and enable movement of the stopper relative to the metallurgical vessel and the discharge opening thereof. The present invention also relates to an assembly of such stopper and such stopper rod apparatus.

Devices of this general type are known, for example as disclosed in European EP 0 358 353 A2. In such known system, a refractory ceramic stopper has built thereinto a metallic coupling having internal threads. A stopper rod having an outer thread can be screwed into the metallic coupling in the stopper. As a result, the stopper is mounted on the stopper rod. However, this known arrangement has a number of disadvantages.

For example, when the stopper is manufactured, the metallic threaded coupling therein is subjected automatically to the firing temperature for manufacture of the stopper, for example 1350° C. During such firing, the threaded metallic coupling can become oxidized. Cracks also can be formed due to the different coefficients of thermal expansion of the ceramic material of the stopper and the metal material of the threaded coupling. All such occurrences have a negative impact on the function and operation of the threaded coupling.

Also in this known system, the thread of the threaded coupling and the thread of the stopper rod must be complementary to each other. As a consequence, when a given installation already has an existing stopper rod, then only stoppers having threaded couplings with precisely matching threads can be employed with such already existing stopper rod. Therefore, when there exist a number of stopper rods having varying threads, it is necessary to provide availability of stoppers with a number of matching threaded couplings. This is an impractical requirement.

Further, systems of this general type normally also are employed to feed gas into the stopper for various purposes. In the system of EP 0 358 353 A2, after the stopper rod has been screwed into the threaded coupling, it must be guaranteed that sealing surfaces of the stopper and the stopper rod are in sealing contact. However, this is possible only if the longitudinal axis of the threaded coupling and the longitudinal axis of the stopper rod are precisely coaxial. In practical operation, such precise coaxial alignment can be achieved only with difficulty. As a result, leaks can occur. Particularly, during a tightening process of a tightening nut employed in such system, a sealing surface of the stopper rod has a tendency to be moved relative to a sealing surface of the stopper. This is due to the fact that the mating threads of the screw coupling automatically have a certain amount of play. Leaks also can occur due to the different coefficients of thermal expansion of the ceramic material of the stopper and the metal material of the stopper rod. As a result, cracks can form in the ceramic material of the stopper. All such leaks are undesirable.

SUMMARY OF THE INVENTION

With the above discussion in mind, it is an object of the present invention to provide an assembly including a refractory ceramic stopper and a stopper rod apparatus for mounting and support thereof whereby it is possible to overcome the above and other prior art disadvantages.

It is a particular object of the present invention to provide such an assembly whereby it is possible to assemble the stopper onto the stopper rod while avoiding the use of a threaded coupling.

It is an even further object of the present invention to provide such an assembly whereby the stopper may be locked on to the stopper rod quickly and surely by a relatively simple manipulative operation and whereby this may be achieved by simple and inexpensive means without detracting from the strength or quality of the individual elements of the assembly.

It is a further object of the present invention to provide a stopper and a stopper rod apparatus for use in such assembly.

The above objects are achieved in accordance with the present invention by the provisions that a recess or chamber conventionally provided in a refractory ceramic stopper and into which is to be inserted an end of the stopper rod has an enlargement or enlarged portion that defines a stop surface, that the end of the stopper rod that is inserted into the recess or chamber in the stopper is provided with a support surface, and that plural spreadable members having opposite first and second ends are positioned about the stopper rod and are insertable therewith into the recess in the stopper. The spreadable members are operable such that, as the stopper rod and spreadable members are inserted into the recess, when first ends of the spreadable members reach the enlarged portion of the recess within the stopper, the spreadable members spread outwardly relative to the stopper rod. Particularly, such spreading results in first ends of the spreadable members entering the enlarged portion of the recess and confronting or abutting the stop surface of the stopper, with the second ends of the spreadable members confronting or abutting the support surface of the stopper rod. As a result, the stopper is locked on the stopper rod. This may be achieved simply by sliding the stopper rod and spreadable members into the recess or chamber within the stopper. When this insertion has proceeded to a predetermined position, the spreadable members automatically spread outwardly with the result that the stopper becomes locked on the stopper rod and cannot be removed therefrom. Again, this is achieved by a simple longitudinal sliding movement of the stopper rod relative to the stopper, and it is not necessary to rotate such elements relative to each other, as has been necessary in the threaded arrangements of the prior art. Thus, mating threads within the stopper and on the stopper rod are totally unnecessary, with the result that the above discussed prior art disadvantages are totally avoided. Furthermore, since no threaded engagement or mating between the stopper and stopper rod is provided, the relative rotation between such elements that has been necessary in the past no longer is necessary, and assembly thereby is substantially facilitated.

In a preferred arrangement of the invention, the stopper rod has an outer threaded portion and a washer fits around the stopper rod and is pressed by operation of the thread on the stopper rod toward or against an outer end face of the stopper. This pressing results in a secure clamping of the spreadable members against the stop surface of the stopper and the support surface of the stopper rod. The washer itself can be guided with an inner thread on the outer threads of the stopper rod. Preferably however, the washer is pressed toward or against the end face of the stopper by means of a threaded nut meshing with the outer threads of the stopper rod. Furthermore, it is possible to provide a packing positioned between the washer and the end face of the stopper. Such packing is compressed during the tightening of the nut. As a result, it is possible to provide a gas seal, when desired, at the outer end of the recess into the stopper. This makes it possible for a gas, for example a flushing gas, to be introduced into the stopper, for example through the stopper rod, and such gas will not escape into the region of the locking structure.

In accordance with a further feature of the present invention, the spreadable members spread outwardly relative to the stopper rod under the influence of an elastic force. This elastic force may be provided by an annular spring or elastic member enclosing or surrounding the spreadable members at a position such that, when the first ends of the spreadable member reach the enlarged portion of the recess in the stopper, the spreadable members automatically are spread outwardly relative to the stopper rod. This elastic force need only exist during assembly of the stopper rod apparatus to the stopper. This force need not exist thereafter, since the spreadable members are clamped between the stop surface and the support surface due to the tightening operation. Thus, the annular spring, for example a rubber ring, may become destroyed after the assembly is placed in service, for example due to heat from a molten metal.

The invention also includes a stopper including features as discussed above, as well as a stopper rod apparatus including features as discussed above.

In accordance with the above and other features of the present invention to be described in more detail below, there is provided a simple construction and ease of assembly that enables substantial advantages over prior art systems. Furthermore, the stopper rod in accordance with the present invention does not have to be manufactured with any particular shapes or portions provided with close or narrow tolerances. Thus, assembly of the stopper to the stopper rod is achieved surely and simply without any such close or narrow tolerances.

Furthermore, the expansion or enlarged portion of the recess formed in the stopper need not be large. Therefore, the provision of such expansion or enlarged portion weakens the stopper only slightly if at all. Furthermore, the parts of the stopper rod apparatus, namely the stopper rod and the spreadable members, preferably are formed of a metal material such as steel and therefore can be used repeatedly when it becomes necessary to replace a used stopper.

BRIEF DESCRIPTION OF THE DRAWINGS

Other objects, specifically preferred features and advantages of the present invention will be apparent from the following detailed description, taken with the accompanying drawings, wherein.

DETAILED DESCRIPTION OF THE INVENTION

Figure 1:
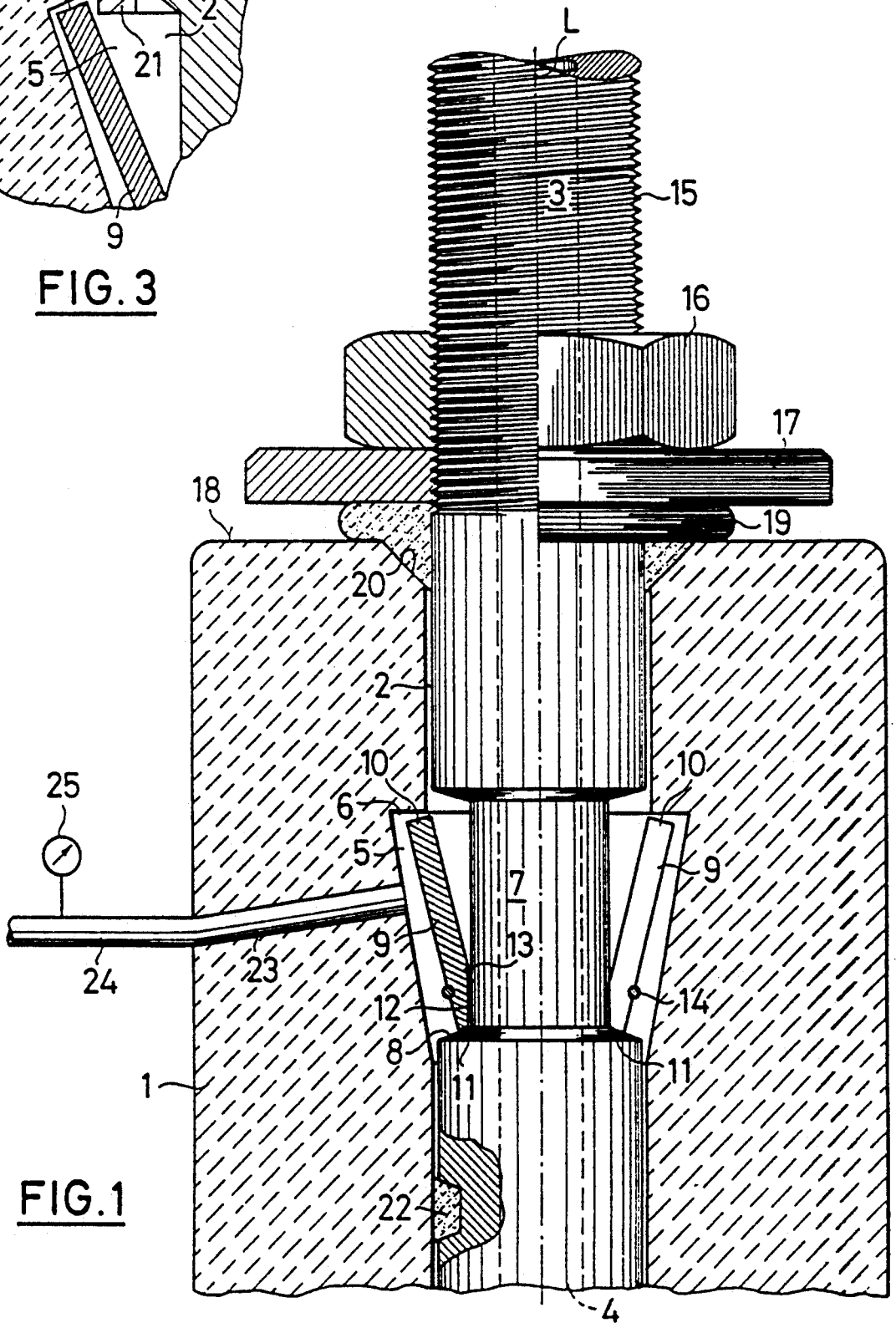
FIG. 1 is a fragmentary longitudinal sectional view of an assembly in accordance with one embodiment of the present invention, and illustrating a stopper locked to a stopper rod.

In FIG. 1 is fragmentally illustrated a stopper 1 formed of a suitable refractory ceramic material as would be understood by one skilled in the art, such stopper to be employed in a known manner in association with a discharge opening of a metallurgical vessel containing molten metal, not shown. Stopper 1 has formed therein a recess or chamber 2 for receipt of an end of a stopper rod 3, for example formed of metal as would be understood by one skilled in the art. Stopper rod 3 may be tubular and have therethrough an axial channel 4, for example to guide a gas, such as a flushing gas, through the stopper and into molten metal in the metallurgical vessel.

In accordance with the present invention, the recess or chamber 2 includes and is formed with an outwardly extending expansion or enlarged portion 5. In the illustrated arrangement, recess or chamber 2 is cylindrical and has a longitudinal axis coaxial with a longitudinal axis L of stopper rod 3. Enlarged portion 5 extends annularly and outwardly of the cylindrical recess 2. Enlarged portion 5 is formed such that a stop surface 6 is formed to extend in a plane that is radial to longitudinal axis L, as shown in FIG. 1. Alternatively however, it is possible to provide stop surface 6 to extend slightly conically relative to axis L, as illustrated for example in FIG. 3. Enlarged portion 5 is wedge-shaped in profile, i.e. tapered in longitudinal section, for example as viewed in FIG. 1, such that enlarged portion 5 tapers downwardly and inwardly or converges in a direction away from stop surface 6. Thus, the outer surface of enlarged portion 5 extends conically and converges from stop surface 6 to intersect or join with the surface defining cylindrical recess 2. Due to the relatively slight dimension of the enlarged portion 5 outwardly of recess 2, stopper 1 is weakened only slightly.

The outer surface of stopper rod 3 is provided with a cylindrical narrowed portion 7 that defines with the outer surface of stopper rod 3 a step forming a conical support surface 8.

A plurality of spreadable segments or members 9 are provided to be locked between stop surface 6 and support surface 8. For example, spreadable members 9 preferably are in the shape of annularly separated segments of a cylinder surrounding stopper rod 3 before outward spreading of members 9. This may be illustrated, for example, in the left-hand portion of FIG. 2. If for example three spreadable members 9 are provided, then each member would extend around approximately 120° of the circumference of the stopper rod, or more precisely of the narrowed portion 7 in the illustrated embodiment. Further for example, if four members 9 are provided, each member would extend around approximately 90° of the circumference of the stopper rod or the narrowed portion 7 thereof. Members 9 as illustrated are formed of a suitable steel material. However, such members also may be formed of other suitable materials such as ceramic capable of withstanding the operating temperatures to which the assembly is to be subjected.

Each member 9 has an upper end defined by an edge 10 to confront or abut stop surface 6 and a bottom end defined by an edge 11 to confront or abut support surface 8. It is to be understood that as employed herein the terms "upper" and "lower" refer to the alignment illustrated in the drawings, since this is the normal alignment employed. However, such terms are not intended to be limiting to the scope of the invention. Each member 9 has adjacent the lower end thereof an inner chamfered surface 12 that is complementary to the narrowed portion 7 and in contact therewith when the member 9 is spread outwardly. Chamfered surface 12 intersects the inner axially extending surface of member 9 and defines therewith an edge 13 forming a fulcrum about which pivots the spreadable member 9 when it spreads outwardly. This pivoting and outward spreading relative to stopper rod 3 may be due to the influence of an elastic force, for example provided by an annular spring 14, for example an elastic rubber ring, surrounding or enclosing all of the members 9. Ring 14 particularly engages each member 9 at a relative axial position thereof between edge 13 and edge 11. This positioning ensures tipping or outward spreading of the members 9 about respective edges 13.

Figure 2:
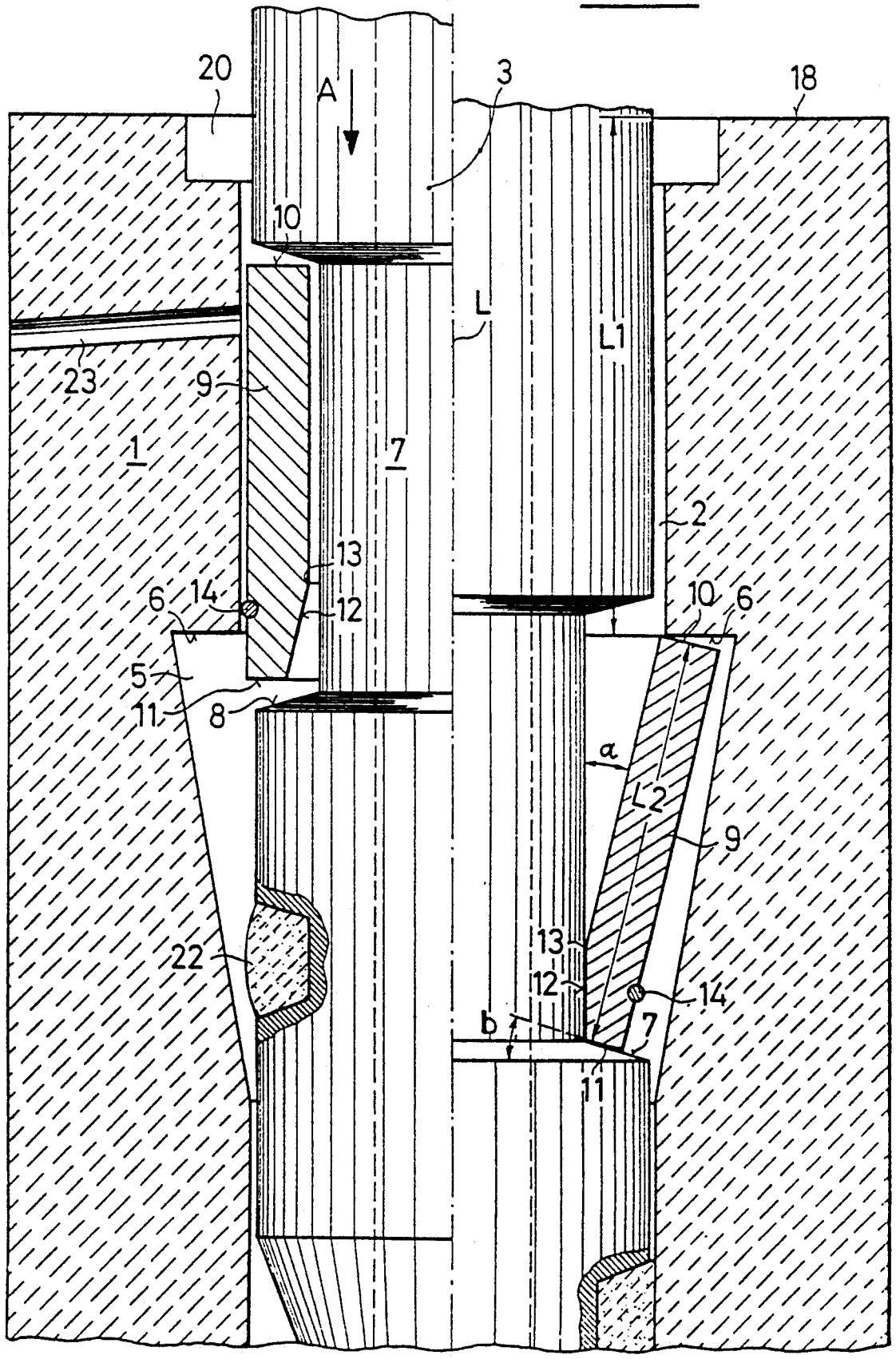
FIG. 2 is a view similar to FIG. 1, but illustrating modifications of the invention, and wherein the left side of such figure illustrates relative positions of various elements of the assembly during assembly, and the right side of such figure illustrates such elements after assembly and locking.

In an initial position of members 9 relative to stopper rod 3, as illustrated in the left-hand portion of FIG. 2, members 9 are accommodated within the narrowed portion 7. Thus, segments 9 are arranged axially and can be inserted with rod 3 into the recess 2 in stopper 1. When the upper ends of members 9 reach or are aligned with the enlarge portion 5, spring 14 operates to automatically pivot members 9 about respective edges 13, such that the upper ends of members 9 fit within enlarged portion 5 with upper edges 10 confronting surface 6. Also, lower edges 11 then will confront surface 8.

In the illustrated arrangement of FIGS. 1 and 2, the bottom edges 11 are partially conical and are complementary to conical support surface 8. As a result, when the members 9 are spread outwardly, end surfaces 11 contact support surface 8 in a surface-to-surface manner, i.e. with area-to-area contact of such surfaces. Furthermore, as illustrated in the right-hand portion of FIG. 2, an angle a of chamfer of chamfered surface 12 approximately or precisely is equal to an angle b of conicity of conical support surface 8. This angle preferably is approximately 15°, but may be larger or smaller. A preferred range is from 5° to 30°.

Figure 3:
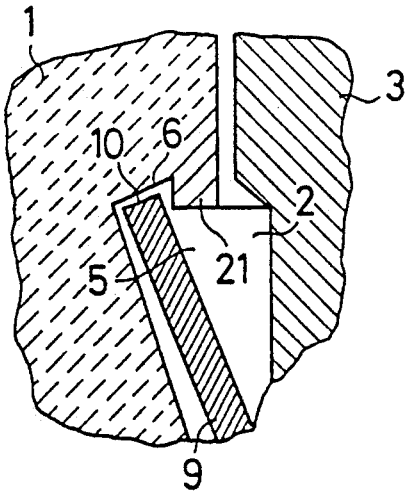
FIG. 3 is a partial sectional view illustrating a modified embodiment.

In the arrangement shown in FIG. 1 and in the right-hand portion of FIG. 2, upper end surface 10 of each member 9 contacts stop surface 6 in an edge-to-surface manner. In other words, this contact is not surface-to-surface. However, it is possible to configure surface 6 or surfaces 10 to achieve such surface-to-surface contact. For example, as illustrated in FIG. 3, it is possible to provide surface 6 to extend conically, with the result that, when the members 9 are spread outwardly, surfaces 10 can be made to extend parallel to and therefore contact surface 6 in a surface-to-surface manner. Alternatively, as illustrated in FIG. 4, it is possible to provide surfaces 10 of members 9 to be tapered in a manner to extend parallel to stop surface 6 when the members 9 are spread outwardly.

Figure 4:
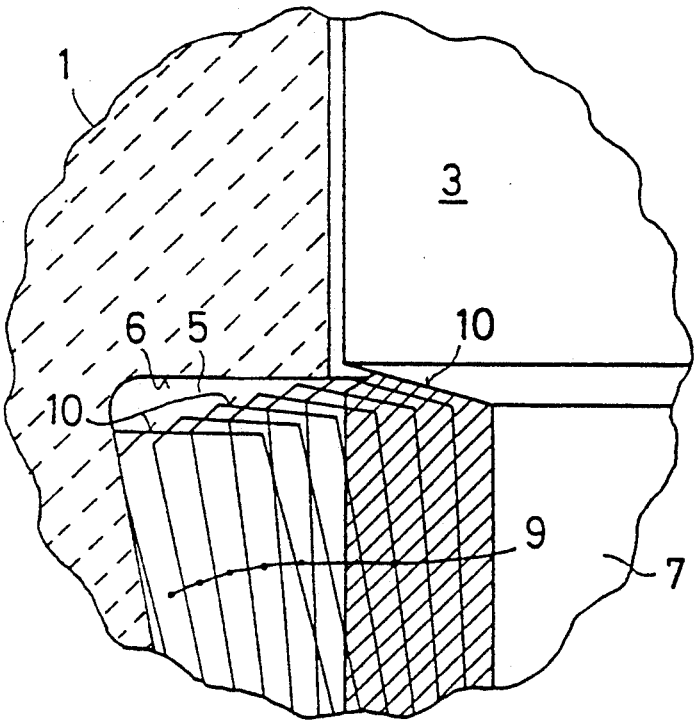
FIG. 4 is an enlarged view similar to FIG. 3 but illustrating a further embodiment.

FIGS. 3 and 4 illustrate a further feature of the present invention. Thus, the embodiment of FIG. 3 illustrates stopper 1 as having an annular projection 21 that is positioned radially between surface 6 and inner recess 2. Projection 21 extends axially beyond surface 6. As a result, when the upper end of members 9 are clamped and locked against surface 6, projection 21 prevents members 9 from folding back out of enlarged portion 5 and into narrowed portion 7. Such folding back could possibly otherwise occur if, for example, the clamping pressure decreases, spring 14 becomes ineffective, and severe jolts or jars are imparted to the assembly. In the arrangement of FIG. 4, when the members 9 are in the outwardly spread positions, clamping pressure will result in upper surfaces 10 contacting in a surface-to-surface manner stop surface 6. Surface 6 extends radially in this embodiment. This is advantageous from a constructional point of view of formation of the stopper. In this clamped position, the above discussed folding inwardly of members 9 would be prevented by the radially outer portions of surfaces 10 contacting or abutting surface 6.

Figure 6:
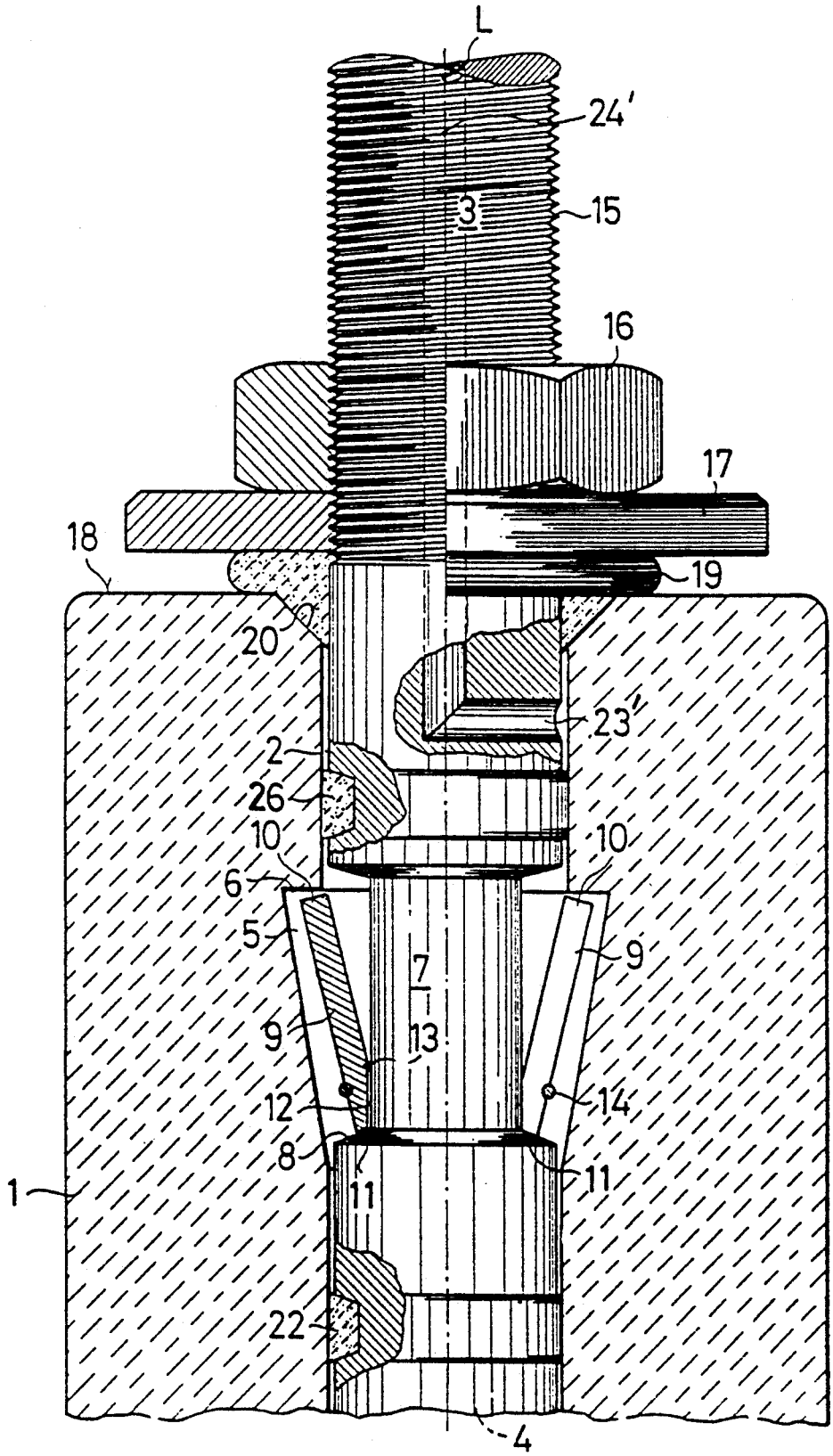
FIG. 6 is a view similar to FIG. 1 but illustrating additional features and embodiments of the present invention.

After the members 9 spread outwardly in the manner mentioned above, clamping of the members 9 between surfaces 6 and 8 can be achieved in the following manner. Thus, stopper rod 3 may be provided with an outer thread 15 to which is threaded an internally threaded nut 16. A washer 17 is positioned between nut 16 and an outer end face 18 of stopper 1. Tightening of nut 16 will press washer 17 against face 18, and this will tend to move rod 3 and members 9 upwardly relative to stopper 1. This will create a pressured clamping of surfaces 10 with surface 6 and of surfaces 11 with surface 8. In the illustrated arrangement, a gas-tight seal is provided by an annular packing 19 positioned between washer 17 and face 18. Packing 19 is of a material having a high temperature resistance, for example formed of ceramic fibers or glass fibers, which may be saturated with graphite, molybdenum, water glass or the like. Packing 19 thus provides a seal between the upper end of stopper 1 and rod 3. To improve this seal, recess 2 may include an outer countersunk portion 20 opening onto end face is and into which is received a portion of packing 19. Countersunk portion 20 may be conical as illustrated in FIGS. 1 and 6, or may be stepped as shown in FIG. 2.

As shown in the right-hand portion of FIG. 2, a distance L1 of end face 18 from stop surface 6 is equal or greater than an axial length L2 of members 9. Thereby it is possible to achieve, on the one hand, that stopper 1 has adequate strength and stability above stop surface 6 and, on the other hand, that there will be a certain degree of compensation for thermal expansion in the direction of the longitudinal axis L.

FIG. 1 illustrates a further feature in accordance with the present invention. Thus, in addition to the upper seal formed by packing 19, an additional annular seal 22 is mounted on stopper rod 3 at a position axially spaced from the seal formed by packing 19, seal 22 sealing against a surface of stopper 1. The two seals thus define a sealed space internally of stopper 1. There also is provided means for introducing gas under pressure into this sealed space. For example, a channel 23 extends through stopper 1 and opens into the sealed space between the two seals. A pressure line 24 having connected thereto a pressure detector, for example manometer 25, is connected to channel 23 to supply a gas, for example an inert gas, under pressure to the sealed space. Manometer 25 indicates the pressure within such space. As long as this pressure is at a predetermined level, manometer 25 indicates that the two seals are effective. However, if the pressure indicated by manometer 25 drops, this is an indication that at least one of the seals has a leak therethrough and no longer is satisfactorily tight. Such a leak could allow external oxygen to be drawn into molten metal within the metallurgical vessel. Such an indication therefore could be taken that it is necessary to replace one or both of the seals.

Specific assembly of the above described device may be as follows. Thus, members 9 may be mounted around narrowed portion 7 of rod 3 and held thereat by spring 14. In this position, i.e. outwardly of stopper 1, members 9 would be tipped outwardly around edges 13. Subsequently the rod and members are inserted into recess 2 of stopper 1 in the direction of arrow A in FIG. 2. During this operation, the members 9 swivel inwardly about edges 13 into narrowed portion 7, as shown in the left-hand portion of FIG. 2. Further insertion movement will result in upper surfaces 10 reaching enlarged portion 5, whereupon spring 14 will cause members 9 to pivot outwardly about edges 13 until chamfered surfaces 12 of members 9 rest against the cylindrical narrowed portion 7. Thus, insertion requires only a relative longitudinal sliding movement, and a specific rotational position of stopper 1 relative to rod 3 is immaterial. Packing 19 then is pressed against end face 18 by washer 17 and nut 16. During tightening of nut 16, members 9 simultaneously are clamped between support surface 8 and stop surface 6. In this manner, the stopper 1 is tightly and firmly locked onto stopper rod 3. During use or service of the assembly, spring 14 will lose its elastic or spring force. This however will not cause the mounting of the stopper to become loose, since members 9 are tightly clamped between surfaces 6 and 8. When stopper 1 becomes worn to the point that it needs to be replaced, then stopper 1 simply can be broken off stopper rod 3, and a new stopper can be mounted thereon in the manner described above.

Figure 5:
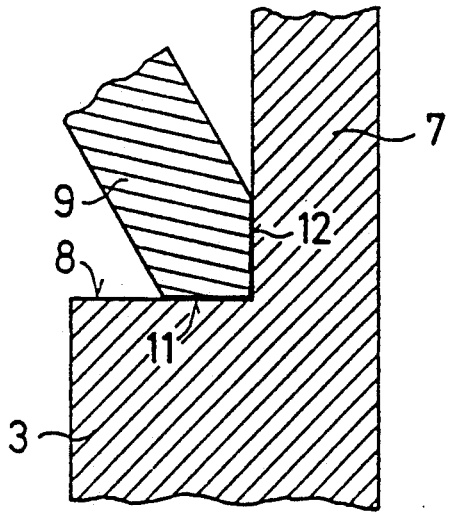
FIG. 5 is an enlarged view illustrating another embodiment of a different portion of the assembly.

In the embodiment of FIGS. 1 and 2, support surface 8 is illustrated as being chamfered or conical. This however is not necessary. Thus, it also is possible to provide surface 8 to extend radially of axis L. Such an arrangement is shown in FIG. 5, wherein there also is shown that bottom edge surface 11 is tapered in a manner to extend parallel to radial support surface 8 when member 9 is spread outwardly, i.e. when chamfered surface 12 is in surface-to-surface contact with narrowed portion 7. This embodiment provides the advantage of simple production of surface 8. Also, there is a good force transfer between members 9 when in the clamped condition.

FIG. 6 illustrates another embodiment of the present invention. Thus, the channel for feeding gas to a sealed space within the stopper is not provided through the stopper itself. Rather, a gas feed line may be connected to an internal axial bore 24' extending through rod 3 and opening into one or more radial bores 23' opening outwardly of rod 3 into a sealed space within the stopper. In this case, the sealed space is defined between the upper seal formed by packing 19 and a lower annular seal 26 spaced axially therebelow. The sealed space then is positioned beyond, i.e. upwardly, of enlarged portion 5. This arrangement is alternative to the arrangement shown in FIG. 1, but can operate in the same manner, for example with a manometer connected to bore 24' to detect a pressure drop. Further alternatively, seal 26 in FIG. 6 may be replaced by a seal 22 similar to the corresponding seal in the embodiment of FIG. 1. Thus, axial bore or bores 23' enter an enlarged sealed space. Further, the bore 23 of FIG. 1 through the stopper could be caused to open into the sealed space between seal 26 and the seal formed by packing 19 in FIG. 6.

Although the present invention has been described and illustrated with regard to preferred feature thereof, it is to be understood that various changes and modifications to the specifically described and illustrated features may be made without departing from the scope of the present invention.

We claim:

1. An assembly comprising:

a refractory ceramic stopper having therein a recess including an outwardly enlarged portion defining a stop surface;

a stopper rod insertable into said recess in said stopper and having a support surface; and plural spreadable members having opposite first and second ends and positioned about said stopper rod to be insertable therewith into said recess in said stopper, said spreadable members being spreadable and, as said stopper rod and spreadable members are inserted into said recess to a position whereat said first ends of said spreadable members reach said enlarged portion of said recess, operable to spread outwardly relative to said stopper rod, with said first ends of said spreadable members entering said enlarged portion of said recess and confronting said stop surface of said stopper and with said second ends of said spreadable members confronting said support surface of said stopper rod, thereby locking said stopper on said stopper rod.

2. An assembly as claimed in claim 1, wherein said recess is cylindrical and has an axis aligned with a longitudinal axis of said stopper rod when said stopper is locked thereon, and said enlarged portion extends annularly and outwardly from said cylindrical recess.

3. An assembly as claimed in claim 2, wherein said enlarged portion has a tapered configuration in longitudinal section converging in a direction away from said stop surface.

4. An assembly as claimed in claim 2, wherein said stop surface extends conically of said axis.

5. An assembly as claimed in claim 2, wherein said stop surface is in a plane extending radially of said axis.

6. An assembly as claimed in claim 5, wherein said first end of each said spreadable member is defined by an end surface tapered in a manner to extend parallel to said stop surface when said spreadable member is spread outwardly relative to said stopper rod.

7. An assembly as claimed in claim 2, wherein said stopper includes an axially extending projection positioned radially between said stop surface and said cylindrical recess.

8. An assembly as claimed in claim 1, wherein said spreadable members are in the shape of annularly separated segments of a cylinder surrounding said stopper rod.

9. An assembly as claimed in claim 1, wherein said spreadable members are spreadable outwardly relative to said stopper rod under the influence of an elastic force.

10. An assembly as claimed in claim 9, wherein said elastic force is provided by an annular spring surrounding said spreadable members.

11. An assembly as claimed in claim 1, wherein said stopper rod has a longitudinal axis, an outer surface, and a narrowed portion extending inwardly from said outer surface and defining said support surface.

12. An assembly as claimed in claim 11, wherein said spreadable members fit within said narrowed portion before outward spreading of said spreadable members.

13. An assembly as claimed in claim 11, wherein said support surface extends conically of said longitudinal axis.

14. An assembly as claimed in claim 13, wherein said second end of each said spreadable member is defined by a partial conical end surface complementary to said conical support surface such that when said spreadable member is spread outwardly said end surface contacts said support surface in a surface-to-surface manner.

15. An assembly as claimed in claim 14, wherein said spreadable member has adjacent said second end thereof an inner chamfered surface complementary to said narrowed portion and in contact therewith when said spreadable member is spread outwardly.

16. An assembly as claimed in claim 15, wherein said spreadable member has an axially extending inner surface intersecting said chamfered surface to define therebetween an edge forming a fulcrum about which pivots said spreadable member when spreading outwardly.

17. An assembly as claimed in claim 16, wherein an angle of chamfer of said chamfered surface approximately is equal to an angle of conicity of said conical support surface.

18. An assembly as claimed in claim 11, wherein said spreadable member has adjacent said second end thereof an inner chamfered surface complementary to said narrowed portion and in contact therewith when said spreadable member is spread outwardly.

19. An assembly as claimed in claim 18, wherein said spreadable member has an axially extending inner surface intersecting said chamfered surface to define therebetween an edge forming a fulcrum about which pivots said spreadable member when spreading outwardly.

20. An assembly as claimed in claim 11, wherein said support surface is in a plane extending radially of said longitudinal axis.

21. An assembly as claimed in claim 20, wherein said second end of each said spreadable member is defined by an end surface tapered in a manner to extend parallel to said support surface when said spreadable member is spread outwardly relative to said stopper rod.

22. An assembly as claimed in claim 1, wherein said stopper includes an outer end face, and further comprising means, operable by a thread of said stopper rod, for pressing toward said end face.

23. An assembly as claimed in claim 22, wherein said means comprises a washer on said stopper rod and a nut threaded to said thread of said stopper rod for urging said washer toward said end face.

24. An assembly as claimed in claim 23, further comprising a packing positioned between said washer and said end face.

25. An assembly as claimed in claim 24, wherein said recess includes a countersunk portion opening onto said end face and in which is received a portion of said packing.

26. An assembly as claimed in claim 1, wherein said recess has an axis and opens onto an end face of said stopper, and an axial distance between said end face and said stop surface is at least equal to a length of said spreadable members.

27. An assembly as claimed in claim 1, further comprising two annular seals mounted on said stopper rod at axially spaced positions thereof and sealing against said stopper.

28. An assembly as claimed in claim 27, wherein said seals define a sealed space internally of said stopper, and further comprising means for introducing gas under pressure into said space.

29. An assembly as claimed in claim 28, wherein said means comprises a pressure line having connected thereto a detector to detect a drop of gas pressure in said space indicative of a gas leak through at least one of said seals.

30. An assembly as claimed in claim 29, wherein said pressure line connects to at least one bore in said stopper rod.

31. An assembly as claimed in claim 29, wherein said pressure line connects to a bore in said stopper.

32. An assembly as claimed in claim 27, wherein both said seals are located axially beyond said first ends of said spreadable members.

33. An assembly as claimed in claim 27, wherein a first said seal is located axially beyond said first ends of said spreadable members, and a second said seal is located axially beyond said second ends thereof.

34. A refractory ceramic stopper comprising:

a longitudinally extending internal recess for receipt of a stopper rod on which said stopper is to be locked; and said recess including, at a position intermediate the longitudinal dimension thereof, an annular conical outwardly enlarged portion defining a stop surface to confront ends of spreadable members to be spreadable outwardly from the stopper rod to result in said stopper being locked onto the stopper rod.

35. A stopper as claimed in claim 34, wherein said recess is cylindrical and has an axis to be aligned with a longitudinal axis of the stopper rod, and said enlarged portion extends annularly and outwardly from said cylindrical recess.

36. A stopper as claimed in claim 35, wherein said enlarged portion has a tapered configuration in longitudinal section converging in a direction away from said stop surface.

37. A stopper as claimed in claim 35, wherein said stop surface is in a plane extending radially of said axis.

38. A stopper as claimed in claim 35, wherein said stop surface extends conically of said axis.

39. A stopper as claimed in claim 35, further comprising an axially extending projection positioned radially between said stop surface and said cylindrical recess.

40. A stopper as claimed in claim 34, further comprising a bore extending through said stopper and having an inner end opening into said enlarged portion.

41. An apparatus to be mounted in and locked to a refractory ceramic stopper having therein a recess, said apparatus comprising:

a stopper rod to be inserted into the recess in the stopper and having a support surface; and plural spreadable members having opposite first and second ends and positioned about said stopper rod to be inserted therewith into the recess in the stopper, said spreadable members being spreadable and, as said stopper rod and spreadable members are inserted into the recess, operable to spread outwardly relative to said stopper rod, with said first ends of said spreadable members to confront a stop surface of the stopper and with said second ends of said spreadable members confronting said support surface of said stopper rod, thereby to enable the stopper to be locked on said stopper rod.

42. An apparatus as claimed in claim 41, wherein said first end of each said spreadable member is defined by an end surface tapered in a manner to extend parallel to the stop surface when said spreadable member is spread outwardly relative to said stopper rod.

43. An apparatus as claimed in claim 41, wherein said spreadable members are in the shape of annularly separated segments of a cylinder surrounding said stopper rod.

44. An apparatus as claimed in claim 41, wherein said spreadable members are spreadable outwardly relative to said stopper rod under the influence of an elastic force.

45. An apparatus as claimed in claim 44, wherein said elastic force is provided by an annular spring surrounding said spreadable members.

46. An apparatus as claimed in claim 41, wherein said stopper rod has a longitudinal axis, an outer surface, and a narrowed portion extending inwardly from said outer surface and defining said support surface.

47. An apparatus as claimed in claim 46, wherein said spreadable members fit within said narrowed portion before outward spreading of said spreadable members.

48. An apparatus as claimed in claim 46, wherein said support surface extends conically of said longitudinal axis.

49. An apparatus as claimed in claim 48, wherein said second end of each said spreadable member is defined by a partial conical end surface complementary to said conical support surface such that when said spreadable member is spread outwardly said end surface contacts said support surface in a surface-to-surface manner.

50. An apparatus as claimed in claim 49, wherein said spreadable member has adjacent said second end thereof an inner chamfered surface complementary to said narrowed portion and in contact therewith when said spreadable member is spread outwardly.

51. An apparatus as claimed in claim 50, wherein said spreadable member has an axially extending inner surface intersecting said chamfered surface to define therebetween an edge forming a fulcrum about which pivots said spreadable member when spreading outwardly.

52. An apparatus as claimed in claim 51, wherein an angle of chamfer of said chamfered surface approximately is equal to an angle of conicity of said conical support surface.

53. An apparatus as claimed in claim 46, wherein said spreadable member has adjacent said second end thereof an inner chamfered surface complementary to said narrowed portion and in contact therewith when said spreadable member is spread outwardly.

54. An apparatus as claimed in claim 53, wherein said spreadable member has an axially extending inner surface intersecting said chamfered surface to define therebetween an edge forming a fulcrum about which pivots said spreadable member when spreading outwardly.

55. An apparatus as claimed in claim 46, wherein said support surface is in a plane extending radially of said longitudinal axis.

56. An apparatus as claimed in claim 55, wherein said second end of each said spreadable member is defined by an end surface tapered in a manner to extend parallel to said support surface when said spreadable member is spread outwardly relative to said stopper rod.

57. An apparatus as claimed in claim 41, further comprising means, operable by a thread of said stopper rod, for pressing toward an end face of the stopper.

58. An apparatus as claimed in claim 57, wherein said means comprises a washer on said stopper rod and a nut threaded to said thread of said stopper rod for urging said washer toward the end face.

59. An apparatus as claimed in claim 58, further comprising a packing to be positioned between said washer and the end face.

60. An apparatus as claimed in claim 41, further comprising two annular seals mounted on said stopper rod at axially spaced positions thereof to seal against the stopper.

61. An apparatus as claimed in claim 60, wherein said seals are operable to define a sealed space internally of the stopper, and further comprising means for introducing gas under pressure into the space.

62. An apparatus as claimed in claim 61, wherein said means comprises a pressure line having connected thereto a detector to detect a drop of gas pressure in the space indicative of a gas leak through at least one of said seals.

63. An apparatus as claimed in claim 62, wherein said pressure line connects to at least one bore in said stopper rod.

64. An apparatus as claimed in claim 60, wherein both said seals are located axially beyond said first ends of said spreadable members.

65. An apparatus as claimed in claim 60, wherein a first said seal is located axially beyond said first ends of said spreadable members, and a second said seal is located axially beyond said second ends thereof.

* * * * *